US011772385B2

(12) United States Patent
Butinya Teixido et al.

(10) Patent No.: US 11,772,385 B2
(45) Date of Patent: Oct. 3, 2023

(54) PRINTING FLUID RECIRCULATION

(71) Applicant: Hewlett-Packard Development Company, L.P., Spring, TX (US)

(72) Inventors: David Butinya Teixido, Sant Cugat del Valles (ES); Albert Crespi Serrano, Sant Cugat del Valles (ES); Marta Coma Vives, Sant Cugat del Valles (ES); Jorge Millan Lafuente, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 39 days.

(21) Appl. No.: 17/417,724

(22) PCT Filed: May 28, 2019

(86) PCT No.: PCT/US2019/034096
§ 371 (c)(1),
(2) Date: Jun. 23, 2021

(87) PCT Pub. No.: WO2020/242450
PCT Pub. Date: Dec. 3, 2020

(65) Prior Publication Data

US 2022/0072867 A1 Mar. 10, 2022

(51) Int. Cl.

| | |
|---|---|
| ***B41J 2/18*** | (2006.01) |
| ***B41J 2/17*** | (2006.01) |
| ***B41J 2/175*** | (2006.01) |

(52) U.S. Cl.
CPC ..... *B41J 2/18* (2013.01); *B41J 2/175* (2013.01); *B41J 2/1707* (2013.01)

(58) Field of Classification Search
CPC ..... B41J 2/1707; B41J 2/175; B41J 2/18
See application file for complete search history.

(56) References Cited

U.S. PATENT DOCUMENTS

| | | | |
|---|---|---|---|
| 8,967,745 | B2 | 3/2015 | Borra et al. |
| 8,991,954 | B2 | 3/2015 | Govyadinov et al. |
| 2017/0361618 | A1 | 12/2017 | Wagner et al. |

FOREIGN PATENT DOCUMENTS

| | | | |
|---|---|---|---|
| EP | 3459745 | A1 | 3/2019 |
| KR | 101365347 | B1 | 2/2014 |
| WO | WO-2018139986 | | 8/2018 |
| WO | WO-2018182674 | | 10/2018 |
| WO | WO-2018194642 | | 10/2018 |

*Primary Examiner* — An H Do

(57) ABSTRACT

A printing device and method is described comprising: selectively generating a negative fluid pressure between one of one or more printing fluid supplies and a first one of first and second ports of a printhead; selectively generating a positive fluid pressure between one of said printing fluid supplies and a second one of the first and second ports of the printhead; and providing a first pulsed signal to a first priming pump associated with a first one of the first and second ports, wherein the first one of said first and second ports of the printhead is opened under the control of said first priming pump, such that printing fluid within the printhead exits the printhead through the first one of the first and second ports.

14 Claims, 10 Drawing Sheets

PRINTING FLUID RECIRCULATION

BACKGROUND

Some printing fluids used in 2D or 3D printers include pigments or particles that can precipitate when the fluid is not moving in the printer. A fluid recirculation system can be used for circulating the fluid in the printer to keep the pigments or particles dispersed in the fluid, for example when the printer is in idle or stand-by mode between priming operations. Such recirculation may also assist in other ways, such as mixing of printing fluids, such as inks and maintaining their temperature.

BRIEF DESCRIPTION OF DRAWINGS

Examples will now be described, by way of example only, with reference to the following schematic drawings, in which.

DETAILED DESCRIPTION

Some inks and other printing fluids comprise pigments or other particles, which can settle and sometimes agglomerate in a flow path or device when the fluid is at rest. Over time, such settling or agglomeration can lead to partial or full blocking of the flow path or device. For example, the settled pigment or particles may make the printing fluid more viscous or form a clot. This can result in the flow of the printing fluid during a subsequent print job being hindered or prevented.

Some examples as described herein provide a printing device, or a method of operating a printing system. Some examples as described herein enable printing fluid (such as ink) contained in a printhead to be recirculated. The term "recirculated" is generally used herein to indicate that the printing fluid is moved from a printhead (or other printing device part downstream of a supply of printing fluid) back to a supply of printing fluid. This recirculation of the printing fluid can better enable pigment or other particles in the printing fluid to remain suspended in the fluid, such as between print jobs. In some examples, this reduces the risk of the pigment or other particles settling or agglomerating. The recirculation of the printing fluid may further provide a cooling effect to the printing fluid. Printheads may increase the temperature of the printing fluid during printing, and if the rise in temperature is too high, the quality of printing may deteriorate over time.

Figure 1:
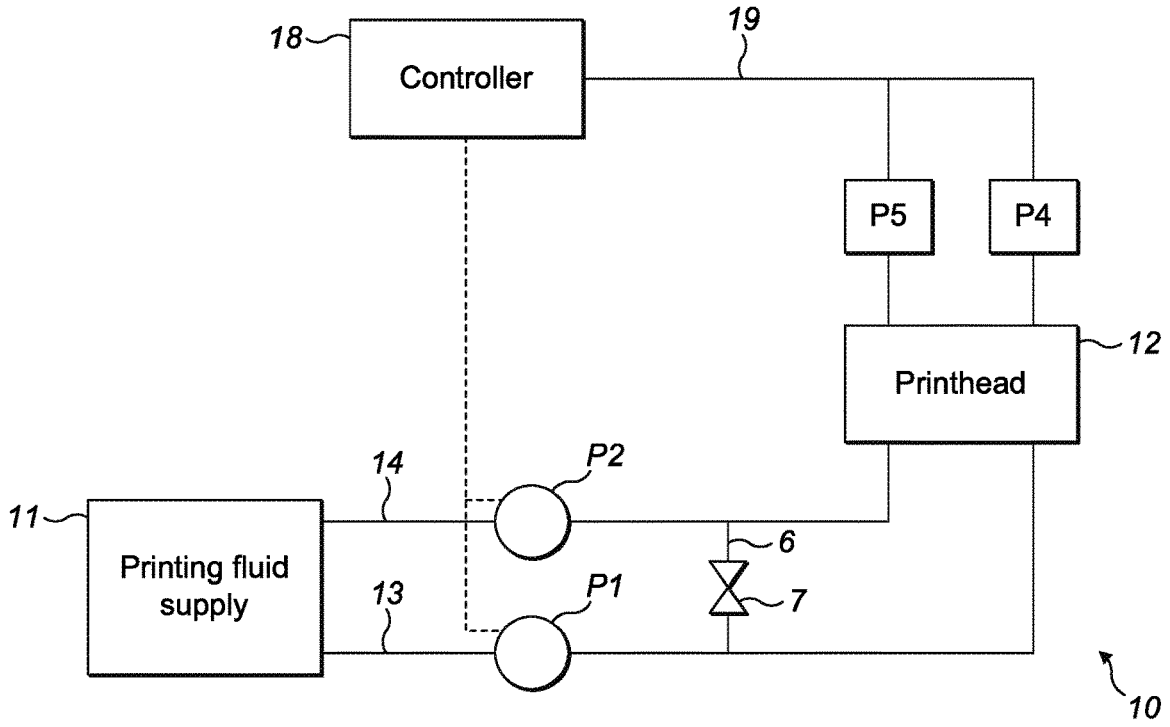
FIGS. 1 to 4 are block diagrams of example systems.

FIG. 1 is a block diagram of a system, indicated generally by the reference numeral 10, in accordance with an example. The system 10 may be a printing device comprising a printing fluid supply 11, a printhead 12, first and second fluid pumps P1 and P2 (selectively activatable fluid pressure sources), first and second priming pumps P4 and P5 (pressure control mechanisms), a valve 7, a first flow path 13, a second flow path 14, a bypass path 6, a controller 18 and a communications link 19. The printhead 12 is connected to the printing fluid supply 11 by the first flow path 13 and the second flow path 14. The printhead 12 comprises a first port (such as a closable first opening) connected to the first flow path 13 and a second port (such as a closable second opening) connected to the second flow path 14.

Although a single printhead is shown in FIG. 1, the system 10 may be modified to provide multiple printheads operating in parallel, as described further below.

The priming pumps P4 and P5 are pressure control mechanisms operable to increase a fluid pressure in the printhead 12. The first port of printhead 12 may be opened in response to an operation of the priming pump P4 and the second port of printhead 12*a* may be opened in response to an operation of the priming pump P5. The first fluid pump P1 may be used for creating a negative fluid pressure between the printing fluid supply 11 and the first port. The second fluid pump P2 may be used for creating a positive fluid pressure between the printing fluid supply 11 and at least the second port. The controller 18 may be configured to control a priming operation using the priming pumps P4 and P5, as described further below.

In an example, the printing fluid supply 11 may take any form suitable to store printing fluid. For example, the printing fluid supply 11 may be a tank or other receptacle. The printing fluid supply 11 may be a closed reservoir or may be open to the atmosphere.

In an example, each of the first and second flow paths 13, 14 may take any suitable form to move printing fluid from one location to another. For example, the first and second flow paths 13, 14 may comprise any combination of tubes, conduits, valves, connectors, pumps or the like. In some examples the first and second flow paths 13, 14 are connected by a bypass path 6. The bypass path 6 may connect a point on the first flow path 13 between the printing fluid supply 11 and the first port of the printhead 12 to a point on the second flow path 14 between the printing fluid supply 11 and the second port of the printhead. The bypass path 6 includes a valve 7 which may be communicatively coupled to and controllable by the controller 18. The valve 7 is normally closed (preventing fluid flow), but may be opened (allowing fluid flow), for example to enable a positive fluid pressure to be simultaneously applied to both the first ports and the second ports, as will be described in more detail later. The first flow path 13 and the second flow path 14 together with the printing fluid supply 11 may form or otherwise be comprised in a printing fluid supply system to supply printing fluid from the printing fluid supply 11 to the printhead 12.

In an example, the printhead 12 may comprise a plurality of nozzles to apply printing fluid to a substrate, such as paper. The printhead 12 may further comprise a regulator mechanism, for regulating the flow of printing fluid into the printhead 12. The printhead 12 is described in more detail below with reference to FIG. 2.

In an example, the priming pumps P4 and P5 are communicatively linked to the controller 18 by a communications links 19, which may be wired or wireless. The priming pumps may thereby be selectively activated by the controller 18. The pressure priming pumps are described in more detail below with reference to FIGS. 5 to 11.

In an example, the first fluid pump P1 is provided to create a negative fluid pressure between the printing fluid supply and the first port of the printhead 12, i.e., to pump printing fluid from the printhead towards the supply (for example, using suction pressure). The first fluid pump P1 may be a selectively activatable fluid pressure source, e.g. activatable by the controller 18. The first pump P1 may comprise an air pump. In some examples the first fluid pressure source may not be selectively activatable. The first fluid pump P1 may be a gravitational fluid pressure source, wherein the negative fluid pressure is created by a height difference between the printing fluid supply 11 and the first ports.

Thus, the first fluid pump P1 is connected between the printing fluid supply 11 and the first port, and may be used to selectively pump printing fluid towards the printing fluid supply 11 through the first flow path 13. In some examples the first fluid pump P1 may also be able to operate in reverse, to pump printing fluid from the printing fluid supply 11 towards the first port. Any suitable type of fluid pump may be used as the first fluid pump P1. For example, the first fluid pump P1 may comprise a suction pump. When the suction pump is activated, it operates to create a fluid flow from the printhead 12 towards the printing fluid supply 11.

In an example, the second fluid pump P2 is provided to create a positive fluid pressure between the printing fluid supply 11 and the second port, i.e., pump printing fluid from the supply towards the second port. The second fluid pump P2 may be a selectively activatable fluid pressure source, e.g. activatable by the controller 18. The second fluid pump P2 may comprise an air pump.

In an example, the printhead 12 may comprise only one priming pump P4 or P5 (i.e. a first priming pump). The first priming pump may selectively be associated with one of the first and second ports. The first priming pump may be alternately connected to a first one of the first and second ports in a forward recirculation mode, and a second one of the first and second ports in a reverse recirculation mode.

Figure 2:
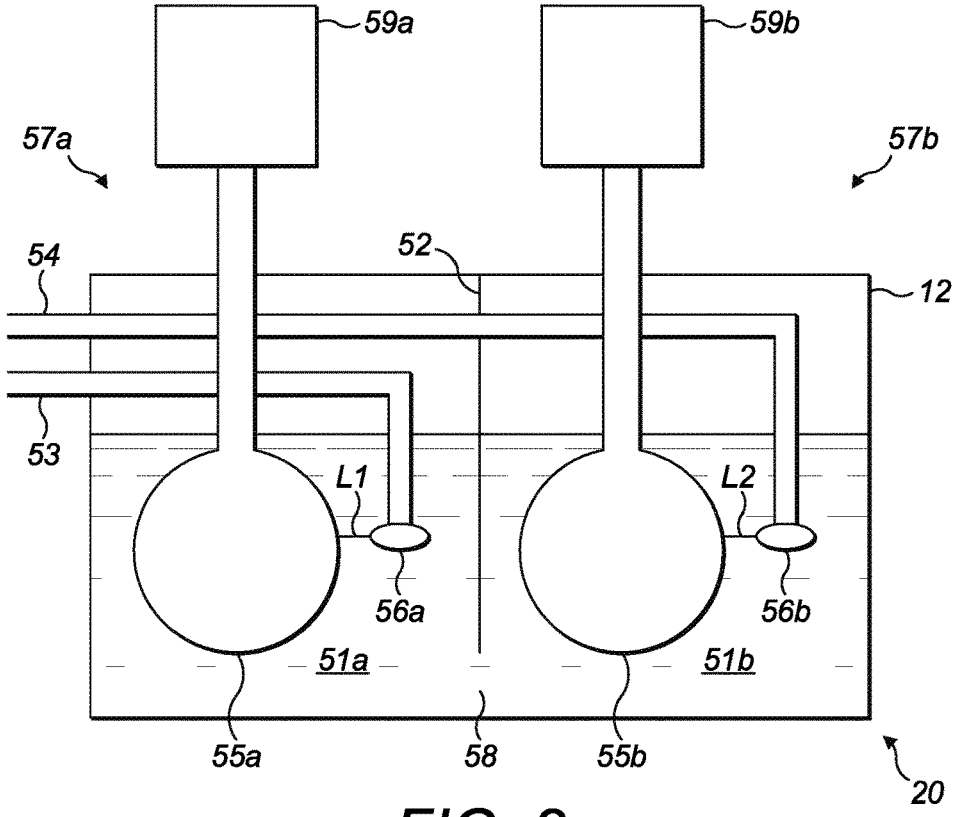

FIG. 2 is a block diagram of a system, indicated generally by the reference numeral 20, in accordance with an example. The system 20 shows an example printhead 12 (which may form part of an inkjet printing system). The system 20 may comprise various features such as filters, nozzles, and the like which are used during a printing operation but are not involved in the recirculation of printing fluid in the printhead. Such features are therefore not described in detail herein.

The printhead 12 may comprise a first chamber 51*a* and a second chamber 51*b*. The first chamber 51*a* is separated from the second chamber 51*b* by a partition 52. The partition 52 does not completely separate the first and second chambers 51*a*, 51*b*, such that the first and second chambers 51*a*, 51*b* are in fluid communication via a gap 58. In one example the first and second chambers 51*a*, 51*b* are substantially identical in size and configuration.

A first port 56*a* of the printhead 12 opens into the first chamber 51*a*, and a second port 56*b* of the printhead 12 opens into the second chamber 51*b*. In the illustrated example, the first port 56*a* comprises an open end of a first tube 53 which extends into the first chamber 51*a*. In other examples, the first tube 53 may not extend into the first chamber 51*a*, in which case the first port 56*a* may comprise an opening in a wall of the first chamber 51*a*. The first tube 53 forms part of the first flow path 13. In the illustrated example, the second port 56*b* similarly comprises an open end of a second tube 54 which extends into the second chamber 51*b*. In other examples, the second tube 54 may not extend into the second chamber 51*b*, in which case the second port may comprise an opening in a wall of the second chamber 51*b*. The second tube 54 forms part of the second flow path 14.

In some examples, the first and second ports 56*a* and 56*b* and their associated closure mechanisms are substantially identical (although this may not be the case in every example). Therefore the first port will be described in detail and the second port will be described in less detail. Unless otherwise stated, features of the first port 56*a* and its associated closure mechanisms may be assumed to be replicated in respect of the second port 56*b*.

In an example, the first port 56*a* comprises a valve to selectively open or close the first port 56*a* and thereby provide or block a flow path between the printhead 12 and the printing fluid supply 11. For example, the first port 56*a* may comprise a needle, which is closable by a printhead regulator valve. A printhead regulator valve may be used for selectively allowing printing fluid into the printhead 12 during a printing operation of the printing device. A printhead regulator valve may open automatically when a level of printing fluid in the printhead 12 drops below a predefined threshold. In one example, the printhead regulator valve may be actuated mechanically, for example, by exploiting a physical effect of the change in printing fluid level.

A pressure control mechanism, such as a regulator 57*a* associated with the printhead 12 is connected to the first port 56*a*. The regulator 57*a* is operable to increase a fluid pressure in the printhead 12. In the particular example, the regulator 57*a* is operable to increase the fluid pressure in the first chamber 51*a*, for example as part of a priming process for the printhead 12.

The regulator 57*a* may comprise an expandable component, such as a regulator bag 55*a*, which is disposed within the first chamber 51*a*. The regulator 57*a* may be associated with a priming pump 59*a* to cause expansion of the regulator bag 55*a*. During normal printing, the interior of the regulator bag 55*a* is open to atmosphere, such that it expands as the amount of printing fluid in the first chamber 51*a* reduces. The regulator bag 55*a* is connected to the first port 56*a* such that expansion of the bag causes the first port 56*a* to open.

In a particular example (as shown in FIG. 2), the regulator bag 55*a* is in contact with a lever L1, such that inflation of the bag causes movement of the lever L1. A valve seat of a valve comprised in the first port 56*a* is provided on the lever L1. The lever L1 and valve seat are configured such that when the regulator bag 55*a* is not inflated the valve seat blocks a valve opening of the first port 56*a*, and when the regulator bag 55*a* is inflated, the valve seat does not block a valve opening of the first port 56*a*. When the regulator bag 55*a* is partially inflated, the lever L1 may be in an intermediate position in which the valve seat partially blocks the valve opening of the first port 56*a*. In some examples the valve may be to control the size of an opening of the first port 56*a*, in which case the connection between the first port 56*a* and the regulator bag 55*a* may be such that the size of the opening of the first port 56*a* is controlled in dependence on the degree of inflation of the regulator bag 55*a*.

The priming pump 59*a* enables the regulator bag 55*a* to be inflated regardless of the printing fluid level in the first chamber 51*a*. Such inflation may, for example, increase the fluid pressure in the first chamber 51*a* in order to force printing fluid out through nozzles of the printhead 12, to remove air or debris from those nozzles.

Operations of the regulator 57*b* in relation to priming pump 59*b*, second port 56*b*, regulator bag 55*b*, lever L2, and the second chamber 51*b* may be similar to the operations of the regulator 57*a* as described above in relation to the priming pump 59*a*, the first port 56*a*, the regulator bag 55*a*, the lever L1, and the first chamber 51*a*.

Figure 3:
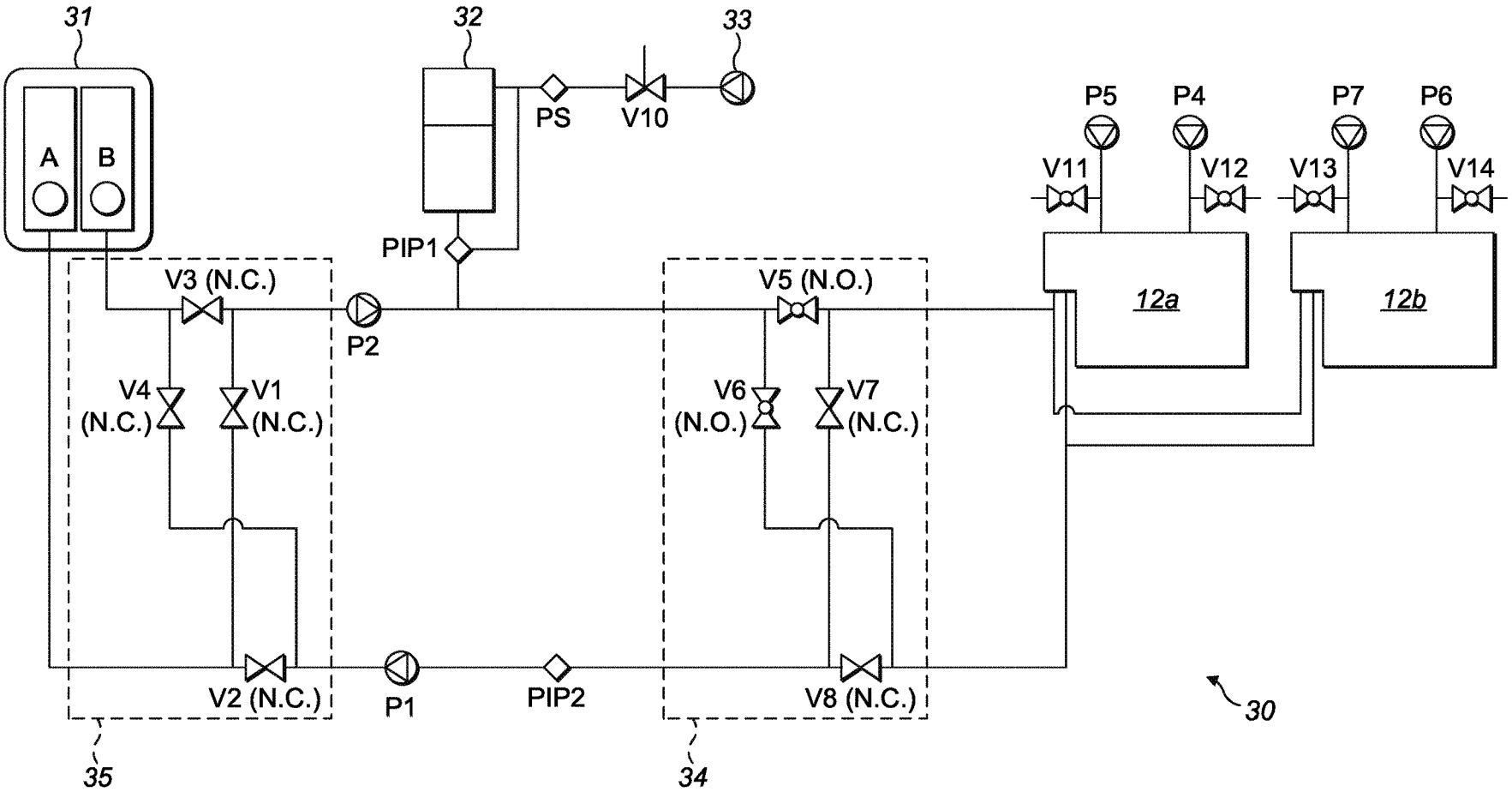

FIG. 3 is a block diagram of a system, indicated generally by the reference numeral 30, in accordance with an example. System 30 shows a printing device, and comprises some of the elements of the printing device shown in the system 10 described above.

The system 30 comprises a first printhead 12*a*, a second printhead 12*b*, a first fluid pump P1, a second fluid pump P2, a first printing fluid supply 31, a second printing fluid supply 32, a printing pump 33, a first valve configuration 34, a second valve configuration 35, a first pressure sensor PIP1, a second pressure sensor PIP2 and a valve V10.

The first and second fluid pumps P1 and P2 are similar to the pumps of the system 10 described above. Similarly, the printheads 12*a* and 12*b* are each similar to the printhead 12 described above.

Printhead 12*a* comprises priming pumps P4 and P5, and printhead 12*b* comprises priming pump P6 and P7. Priming pump P5 may be connectable to an interior of a regulator bag, such as the regulator bag 55*a*, by a valve V11. During normal printing operation, the valve V11 is configured to allow the interior of the regulator bag 55*a* to be open to atmosphere (such that the priming pump P5 is not connected to the regulator bag 55*a*). During recirculation, the valve V11 is configured to allow the interior of the regulator bag 55*a* to be connected to the priming pump P5, such that the interior is not open to the atmosphere. Similarly, the priming pump P4 may be connectable to an interior of a regulator bag, such as the regulator bag 55*b*, by a valve V12. The interior of the regulator bag 55*b* may be open to the atmosphere or may be connected to the priming pump P4 depending on the configuration of the valve V12. Priming pumps P7 and P6 are similarly connectable to the interior of regulator bags of the printhead 12*b* depending on the configuration of valves V13 and P14 respectively.

The first valve configuration 34, comprising valves V5, V6, V7, and V8, is used for implementing a printing mode, a forward recirculation mode, or a reverse recirculation mode, as discussed further below. Valve V5 may be normally open to liquid flow (N.O.), valve V6 may be normally open to liquid flow, valve V7 may be normally closed to liquid flow (N.C.), and valve V8 may be normally closed to liquid flow. The second valve configuration 35, comprising valves V1, V2, V3, and V4, is used for routing printing fluid towards the first printing fluid supply 31 or the second printing fluid supply 32, as discussed further below. In a printing mode of operation, valve V1 may be normally closed, valve V2 may be normally closed, valve V3 may be normally closed, and valve V4 may be normally closed.

In an example, the first printing fluid supply 31 is an ink cartridge (e.g. a replaceable ink cartridge), and the second printing fluid supply 32 is an intermediate tank. It is optional that the system 30 comprises both the first and second printing fluid supplies 31 and 32, such that the printing device may comprise one or more printing fluid supplies. Thus, for example, the system 30 may comprise a single printing fluid supply (such as the supply 11 of the system 10 described above).

Figure 4:
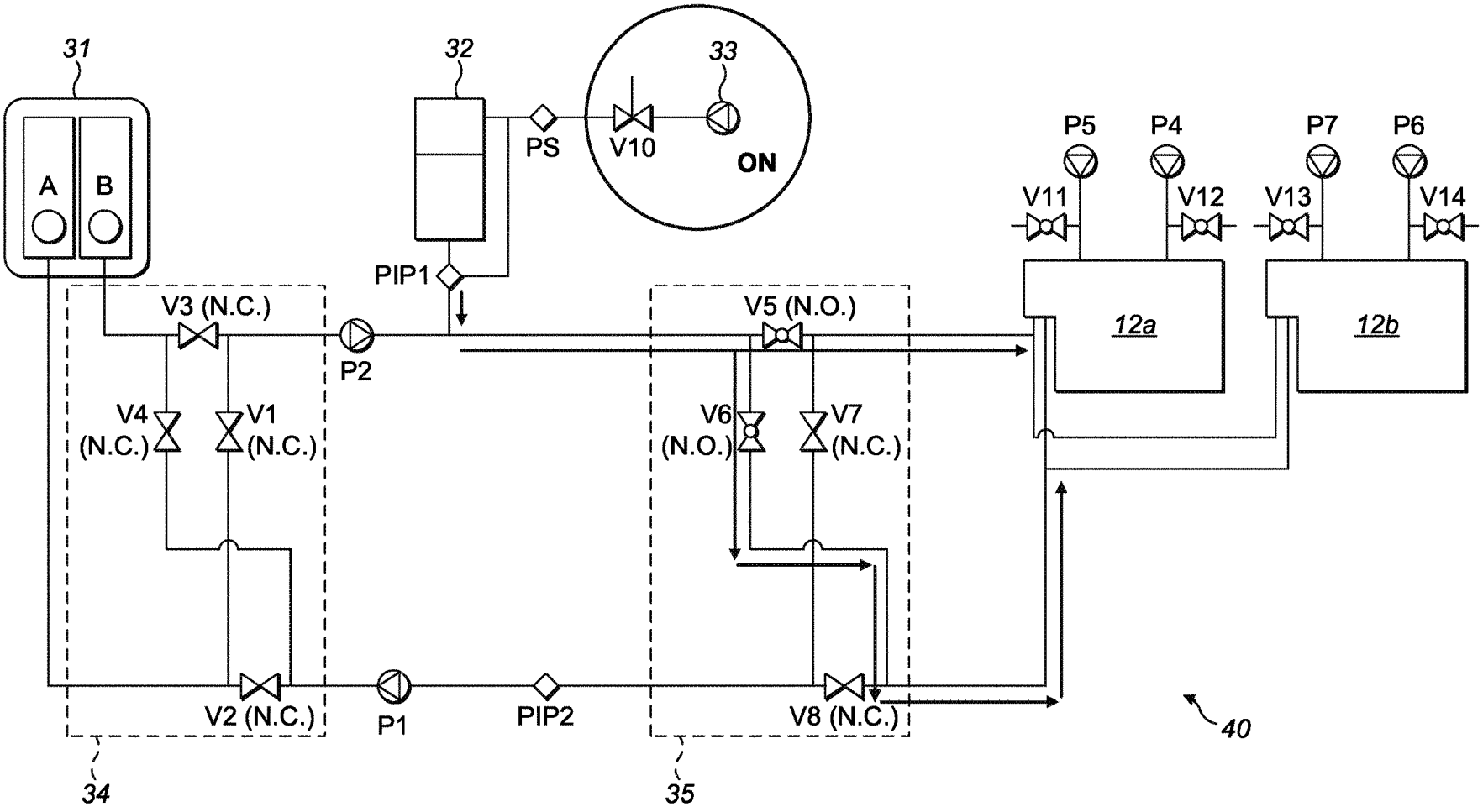

FIG. 4 is a system, indicated generally by the reference numeral 40, in accordance with an example. The system 40 shows the system 30 being used in a printing mode. The system 40 illustrates a flow path (as shown by arrows) of printing fluid when the printing device is in the printing mode.

When the system 40 is in a printing mode, the printing fluid may not be recirculated, and therefore the first and second fluid pumps P1 and P2, and the priming pumps P4, P5, P6, and P7 may be inactive, and printing pump 33 active. Printing fluid may be supplied from the second printing fluid supply 32 and may flow through both a first opening and a second opening of the printheads 12. The printing fluid may also flow through both a first opening and a second opening of the printheads 12*a* and 12*b*. The flow of the printing fluid is facilitated by opening the valves V5 and V6, and closing the valves V7 and V8. This ensures that the printing fluid flows towards the printheads 12*a* and 12*b*, and not back to the printing fluid supplies. For example, viewing in conjunction with FIG. 2, as the printhead 12*a* receives the printing fluid through the first opening, the printing fluid enters the first chamber 51*a* through the first tube 53; as the printhead 12*a* receives the printing fluid through the second opening, the printing fluid enters the second chamber 51*b* through the second tube 54. In the printing mode, the priming pumps 59*a* and 59*b* (pumps P5 and P4 of FIG. 4) may be deactivated, the plurality of nozzles in the bottom surface of the printheads 12*a* and 12*b* may be used for applying the printing fluid to a substrate.

As discussed above, when the printing device is not in a printing mode, the printing fluid may be recirculated (e.g. periodically). FIG. 5 to FIG. 11 illustrates a recirculation mechanism in accordance with examples.

Figure 5:
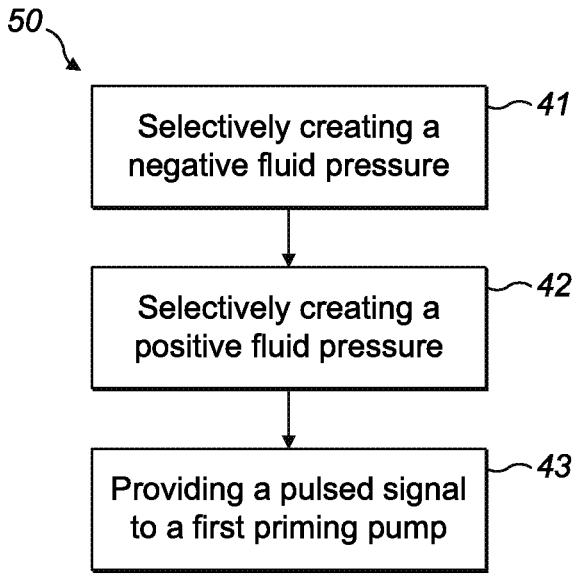
FIGS. 5 and 6 are flowcharts showing algorithms in accordance with examples.
Figure 6:
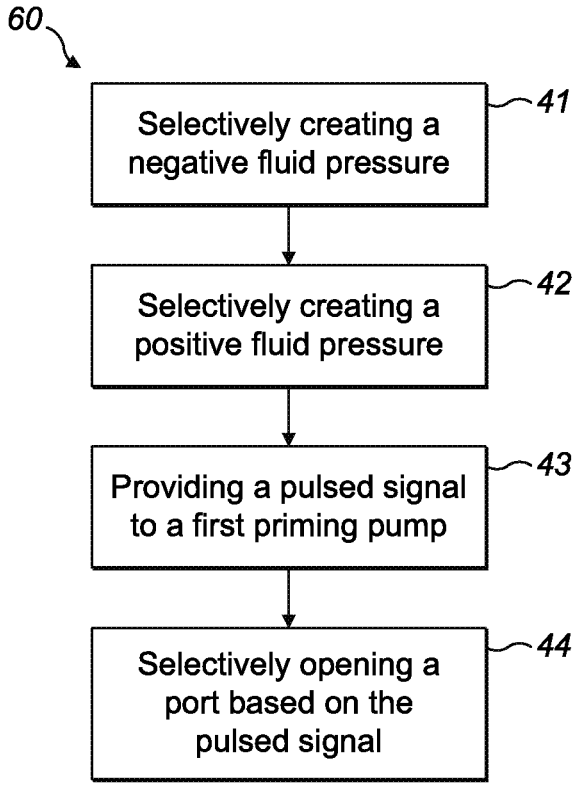

FIGS. 5 and 6 are flowchart of algorithms, indicated generally by the reference numerals 50 and 60 respectively, in accordance with examples. At operation 41, a negative pressure is selectively created between one of one or more printing fluid supplies and a first one of first and second ports of a printhead. At operation 42, a positive pressure is selectively created between one of one or more printing fluid supplies and a second one of the first and second ports of the printhead. At operation 43, a first pulsed signal is provided to a first priming pump in a priming operation.

In the priming operation, at operation 44 of algorithm 60, the first priming pump is activated (for example, the first priming pump provides a pumping action) at each pulse of the first pulsed signal, such that the first one of said first and second ports priming pump is selectively opened at each pulse of the pulsed signal. The priming pump may cause the first one of said first and second ports to remain open during the recirculation cycle, such that the printing fluid exits the printhead through the first one of the first and second ports.

In an example, the first pulsed signal has a duty cycle of 50%. In alternative examples, the duty cycle of the first pulsed signal may vary, for example, based on hardware specifications of the printing device. For example, in some example hardware specifications, the first pulsed signal has a maximum duty cycle of 50%, such that the duty cycle may be in the range of 30% to 50%. In another example, in other example hardware specifications, the pulsed signal may have a maximum duty cycle of 70%. Other duty cycle options are possible in different implementations, such as in the range of 40% to 50%, 40% to 60%, 30% to 70% etc.

Figure 7:
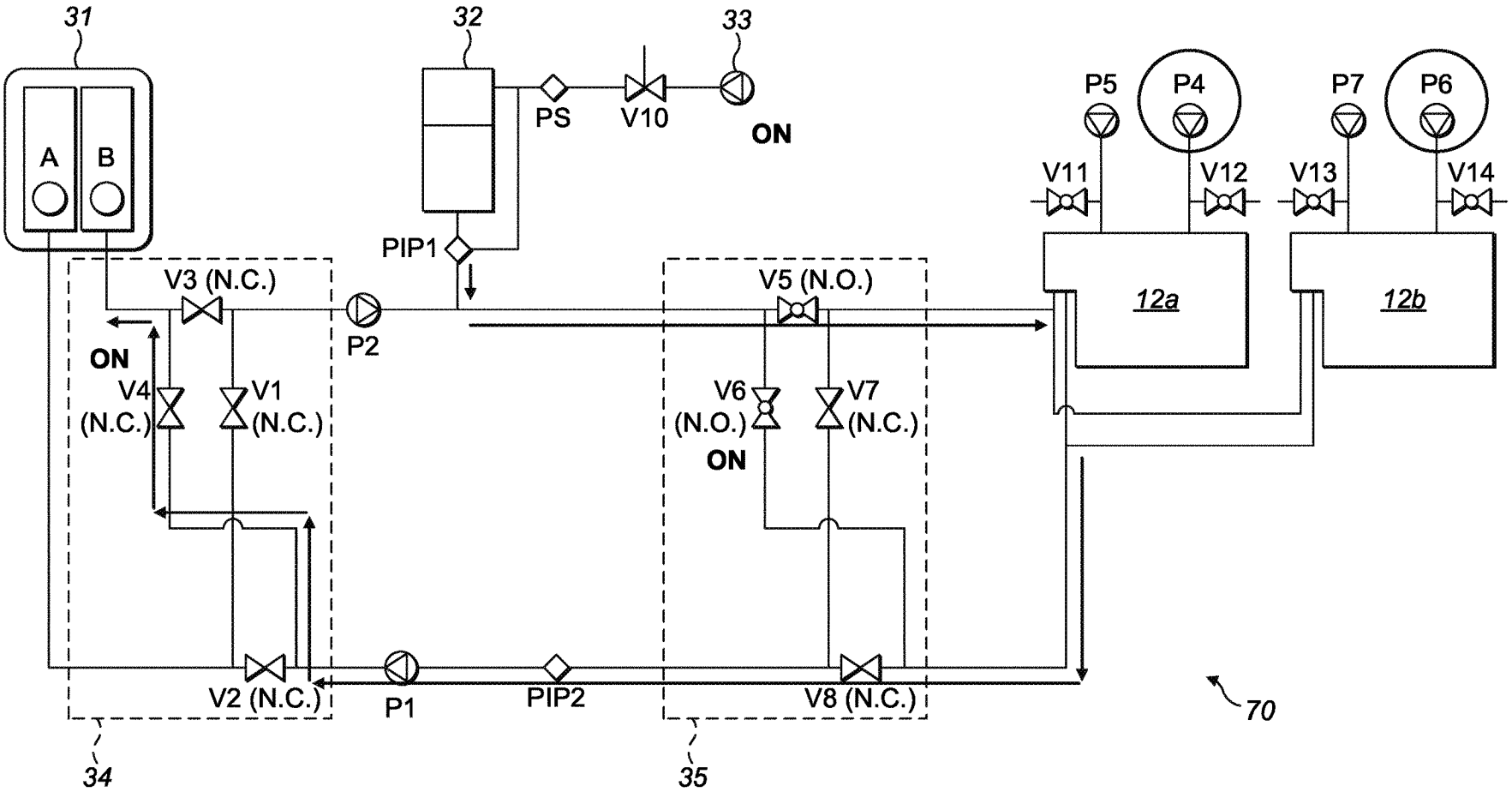
FIGS. 7 to 10 are block diagrams of example systems.

FIG. 7 is a block diagram of a system, indicated generally by the reference numeral 70, in accordance with an example. The system 70 shows the systems 30 and 40 being used in a reverse recirculation mode of operation. The system 70 illustrates a flow path (as shown by arrows) of printing fluid when the printing device is in the reverse recirculation mode.

In the reverse recirculation mode, the first fluid pump P1 creates a negative pressure between the first printing fluid supply 31 and the printheads 12*a*, 12*b*, thereby implementing the operation 41 of the algorithm 40. Further, the second fluid pump P2 creates a positive pressure between the second printing fluid supply 32 and the first port 56*a* of the printheads 12*a*, 12*b*, thereby implementing the operation 42 of the algorithm 40. A pulsed signal is provided to the priming pumps P4 and P6, thereby implementing operation 43 of the algorithm 40. For the reverse recirculation mode, the valves V5 and V8 are open to liquid flow, and the valves V6 and V7 are closed to liquid flow. Thus, ink circulates from the second printing fluid supply 32 to the first printing fluid supply 31 via the printheads 12*a* and 12*b*.

In an example, the valve arrangements of the first valve configuration 34 allow the printing fluid to flow from the second printing fluid supply 32, and back to the first printing fluid supply 31. To achieve this, the valve V4 is open, and the valves V1, V2 and V3 are closed.

In an alternative example, the valve arrangements of the first valve configuration 34 may be different than that shown in system 70. For example, the printing fluid may flow from the second printing fluid supply 32 (as shown), and back to the second printing fluid supply 32 instead of flowing back to the first printing fluid supply 31. The printing fluid may be arranged to flow back to the second printing fluid supply if the valves V2 and V1 are open and the valves V3 and V4 are closed.

In another example, the printing device may comprise only one printing fluid supply, such as the first printing fluid supply 31 (similar to printing fluid supply 11). The valve arrangements of the first valve configuration 34 may allow the printing fluid to flow from the first printing fluid supply 31, and back to the first printing fluid supply 31. In this scenario, the valves V1 and V3 may be omitted. For example, the first printing fluid supply 31 may comprise a first part A and a second part B (as shown in FIG. 3). When the printing fluid is flowing from the second part B back to the first part A, the valve V2 is open, and the valve V4 is closed.

In another example, valves V1 and V3 may be used for refilling the second printing fluid supply 32 with printing fluid from the first printing fluid supply 31. For example, when the printing fluid is provided from the first part A of the first printing fluid supply 31 to the second printing fluid supply 32, valve V1 is open, and when the printing fluid is provided from the second part B of the first printing supply 31 to the second printing fluid supply 32, valve V3 is open.

As will be apparent to those skilled in the art, many other valve configurations and many other fluid supply arrangements are possible.

Figure 8:
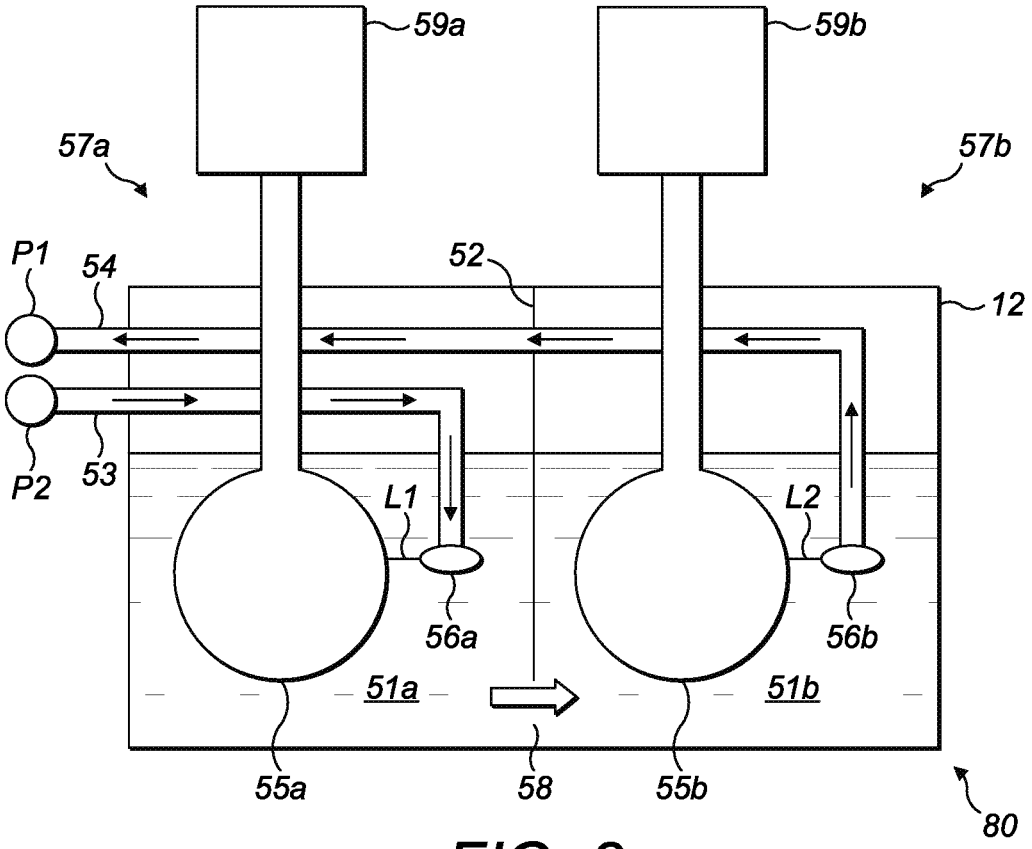

FIG. 8 is a block diagram of a system, indicated generally by the reference numeral 80, in accordance with an example. The system 80 shows the system 20 being used in the reverse recirculation mode of operation. The system 80 illustrates a flow path (as shown by arrows) of printing fluid within the printhead 12.

In the reverse recirculation mode, the first fluid pump P1 creates a negative pressure between a printing fluid supply (such as the first printing fluid supply 31) and the second port 56*b* of the printhead 12, thereby implementing the operation 41 of the algorithm 40. Further, the second fluid pump P2 creates a positive pressure between a printing fluid supply (such as the second printing fluid supply 32) and the first port 56*a* of the printhead 12, thereby implementing the operation 42 of the algorithm 40. A pulsed signal is provided to the priming pump 59*b* (priming pump P4 of FIG. 7), thereby implementing operation 43 of the algorithm 40.

At each pulse of the pulsed signal, the priming pump 59*b* is activated (for example, the priming pump 59*b* provides a pumping action), such that the priming pump 59*b* causes the second port 56*b* to remain open during the recirculation cycle. The pulsed signal may be configured to keep the regulator bag 55*b* inflated over a threshold inflated position and to keep the second port 56*b* open over a threshold open position by using the pulsed pumping action. In order to allow the recirculation to continue over a period of time (for example, time of the recirculation cycle), the second port 59*b* remains open over the threshold open position. Activating the priming pump 59*b* once (without pulsing) may open the second port 56*b* fully, but it is possible that the second port 56*b* fully or partially closes below the threshold open position after a few seconds due to the regulator bag 55*b* deflating gradually (and may read) a partially deflated position below the threshold inflated position) and causing lever L2 to fully or partially block the valve opening of the second port 56*b*. In order to ensure that the second port 56*b* remains open, the pumping action is provided by the priming pump 59*b* at each pulse of the pulsed signal. Thus, each time the pumping action is provided (i.e. at each pulse), the regulator bag 55*b* inflates from a partially deflated position to an inflated position, and thus keeping the second port 56*b* open.

For example, the pulsed signal may be an alternating pulsed signal which is provided for during a recirculation cycle. When a pulse of the pulsed signal is 'high', the regulator bag 55*b* is inflated using the pumping action of the priming pump 59*b*. When a pulse of the pulsed signal is 'low', the priming pump 59*b* is not activated (there is no pumping action), and the regulator bag 55*b* may deflate gradually. Another pumping action is provided at the next 'high' pulse, before the regulator bag 55*b* deflates below the threshold inflated position and before the valve opening of the second port 56*b* reaches below the threshold open position. When the regulator bag 55*b* is inflated (at each 'high' pulse), the second port 56*b* opens fully. The printing fluid thus enters the printhead through the first port 56*a* (which is opened by the action of the fluid pressure applied by the first pump), moves from the first chamber 51*a* to the second chamber 51*b* through the gap 58, and exits the printhead through the second port 56*b* (as shown by the arrows in system 80).

Using a pulsed signal during a recirculation cycle allows the second port 56*b* to be open during the whole recirculation cycle, and thus ensuring that the recirculation does not stop before the recirculation cycle ends. If the regulator bag 55*b* is instructed to stay inflated fully (the second port 56*b* opened fully), continuously through an entire recirculation cycle, the regulator bag 55*b* may deflate (the second port 56*b* closed) when the ink flow is low, and thus the recirculation may stop before the end of the recirculation cycle, which is undesirable. Furthermore, keeping the second port 56*b* open fully for a long period of time may cause a control mechanism (such as a solenoid valve) of the second port 56*b* to be overheated which may cause damage. The pulsed signal allows the valves of the second port 56*b* to remain open throughout the recirculation cycle, and avoids overheating of the valves. Recirculation is performed throughout the recirculation cycle, and is not affected by the level of printing fluid. The duration of the recirculation cycle may also be long if such a pulsed signal is used.

During a recirculation cycle, the pulsed signal may be provided to only one of the priming pumps 59*b*, so that only one of the ports (such as the second port 56*b*, and not the first port 56*a*) is being opened during the recirculation cycle. At a next recirculation cycle, the other one of the ports may be opened. The priming operation is not performed continuously on one port (i.e. priming operation only lasts for the duration of the recirculation cycle) in order to avoid ink drooling at the nozzles of the printhead 12. By using a pulse-prime pressure applied to the regulator bag, we make sure that the bag will be open throughout the whole cycle, and hence recirculate the ink.

Figure 9:
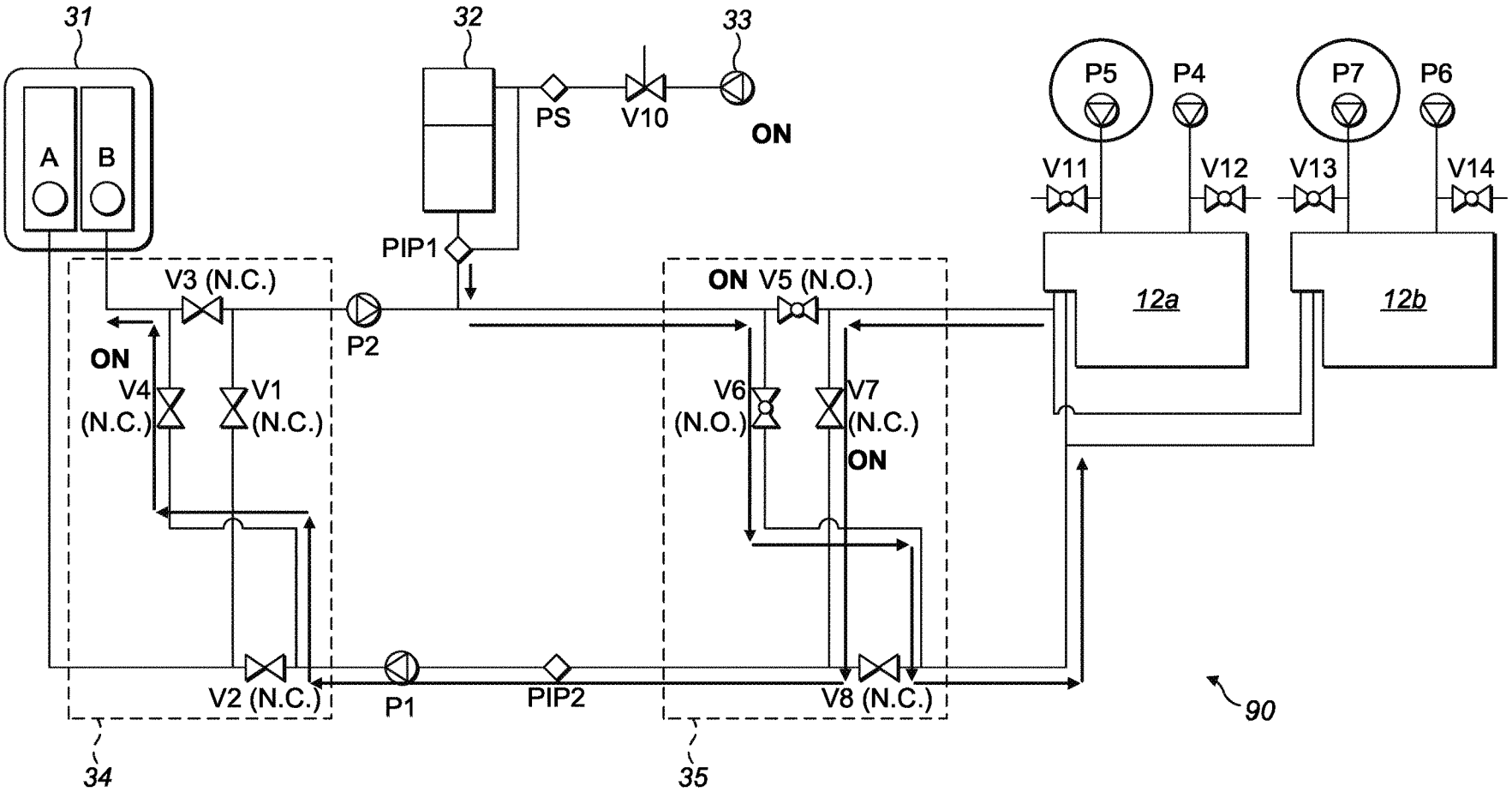

FIG. 9 is a block diagram of a system, indicated generally by the reference numeral 90, in accordance with an example. The system 90 shows the systems 30, 40 and 70 being used in a forward recirculation mode of operation. The system 90 illustrates a flow path (as shown by arrows) of printing fluid when the printing device is in the forward recirculation mode.

In the forward recirculation mode, the first fluid pump P1 creates a negative pressure between the first printing fluid supply 31 and the first port 56*a* of the printheads 12*a*, 12*b*, thereby implementing the operation 41 of the algorithm 40. Further, the second fluid pump P2 creates a positive pressure between the second printing fluid supply 32 and the second port 56*b* of the printheads 12*a*, 12*b*, thereby implementing the operation 42 of the algorithm 40. A pulsed signal is provided to the priming pumps P5 and P7, thereby implementing operation 43 of the algorithm 40. For the forward recirculation mode, the valves V6 and V7 are open to liquid flow, and the valves V5 and V8 are closed to liquid flow. Thus, ink circulates from the second printing fluid supply 32 to the first printing fluid supply 31 via the printheads 12*a* and 12*b*. The valve arrangements of the first valve configuration 34 are similar to that shown in system 70.

Figure 10:
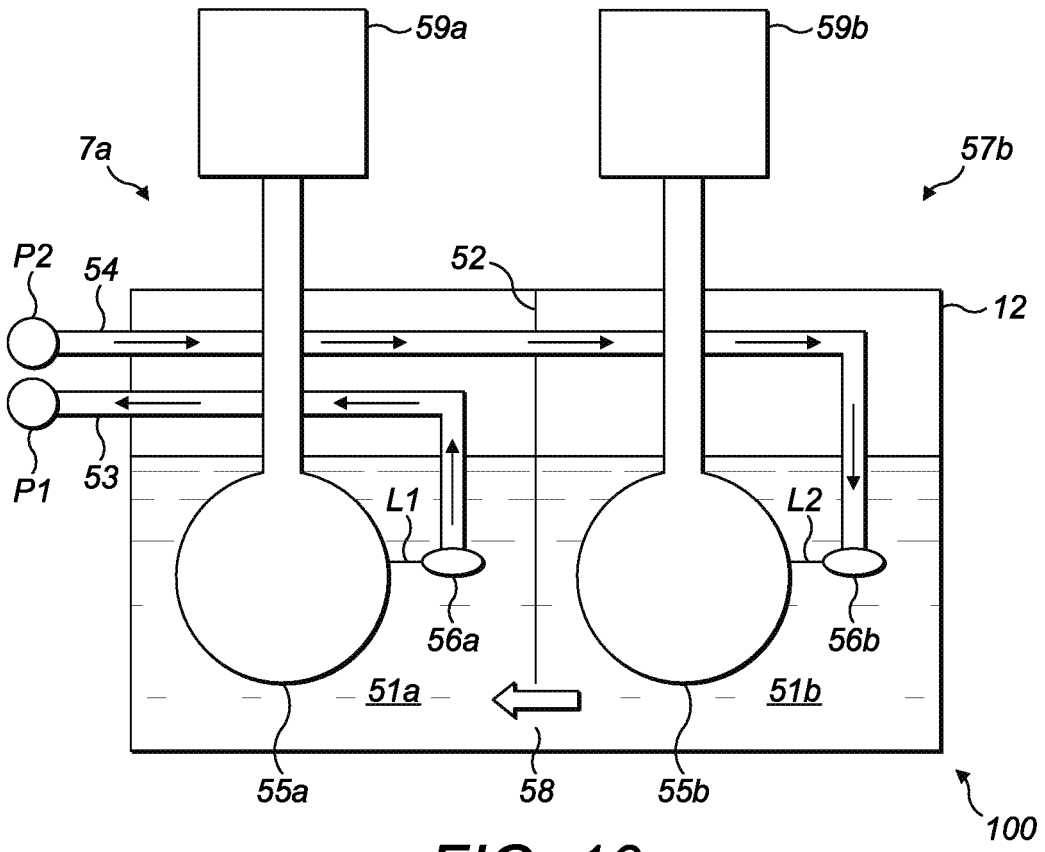

FIG. 10 is a block diagram of a system, indicated generally by the reference numeral 100, in accordance with an example. The system 100 shows the system 20 being used in a forward recirculation mode of operation. The system 100 illustrates a flow path (as shown by arrows) of printing fluid within the printhead 12.

In the forward recirculation mode, the first fluid pump P1 creates a negative pressure between a printing fluid supply (such as the first printing fluid supply 31) and the first port 56*a* of the printhead 12, thereby implementing the operation 41 of the algorithm 40. Further, the second fluid pump P2 creates a positive pressure between a printing fluid supply (such as the second printing fluid supply 32) and the second port 56*b* of the printhead 12, thereby implementing the operation 42 of the algorithm 40. A pulsed signal is provided to the priming pump 59*a* (the priming pump P5 of FIG. 9), thereby implementing operation 43 of the algorithm 40.

At each pulse of the pulsed signal, the priming pump 59*a* is activated (for example, the priming pump 59*a* provides a pumping action), such that the priming pump 59*a* causes the first port 56*a* to remain open during the recirculation cycle. The pulsed signal may be configured to keep the regulator bag 55*a* inflated over a threshold inflated position and to keep the first port 56*a* open over a threshold open position by using the pumping action. The operations of the priming pump 59*a*, the first port 56*a*, the regulator bag 55*a*, and the lever L1 is similar to the operations of the priming pump 59*b*, the second port 56*b*, the regulator bag 55*b*, and the lever L2 as discussed in FIG. 8.

For example, the pulsed signal may be an alternating pulsed signal which is provided for during a recirculation cycle. When a pulse of the pulsed signal is 'high', the regulator bag 55*a* is inflated using the pumping action of the priming pump 59*a*. When a pulse of the pulsed signal is 'low', the priming pump 59*a* is not activated (there is no pumping action), and the regulator bag 55*a* may deflate gradually. Another pumping action is provided at the next 'high' pulse, before the regulator bag 55*a* deflates below the threshold inflated position and before the valve opening of the first port 56*a* reaches below the threshold open position. When the regulator bag 55*a* is inflated (at each 'high' pulse), the first port 56*a* opens fully. The printing fluid thus enters the printhead through the second port 56*b* (which is opened by the action of the fluid pressure applied by the first pump), moves from the second chamber 51*b* to the first chamber 51*a* through the gap 58, and exits the printhead through the first port 56*a* (as shown by the arrows in system 100).

With reference to systems 80 and 100, when priming pump 59*a* (P5) is activated, the priming pump 59*b* (P4) may not be activated, such that only one of the two priming pumps of the printhead 12 is activated at a given time. The priming operation provided by the pulsed signal at the priming pump 59*a* is similar to the priming operation discussed in relation to the priming pump 59*b* in system 80.

Figure 11:
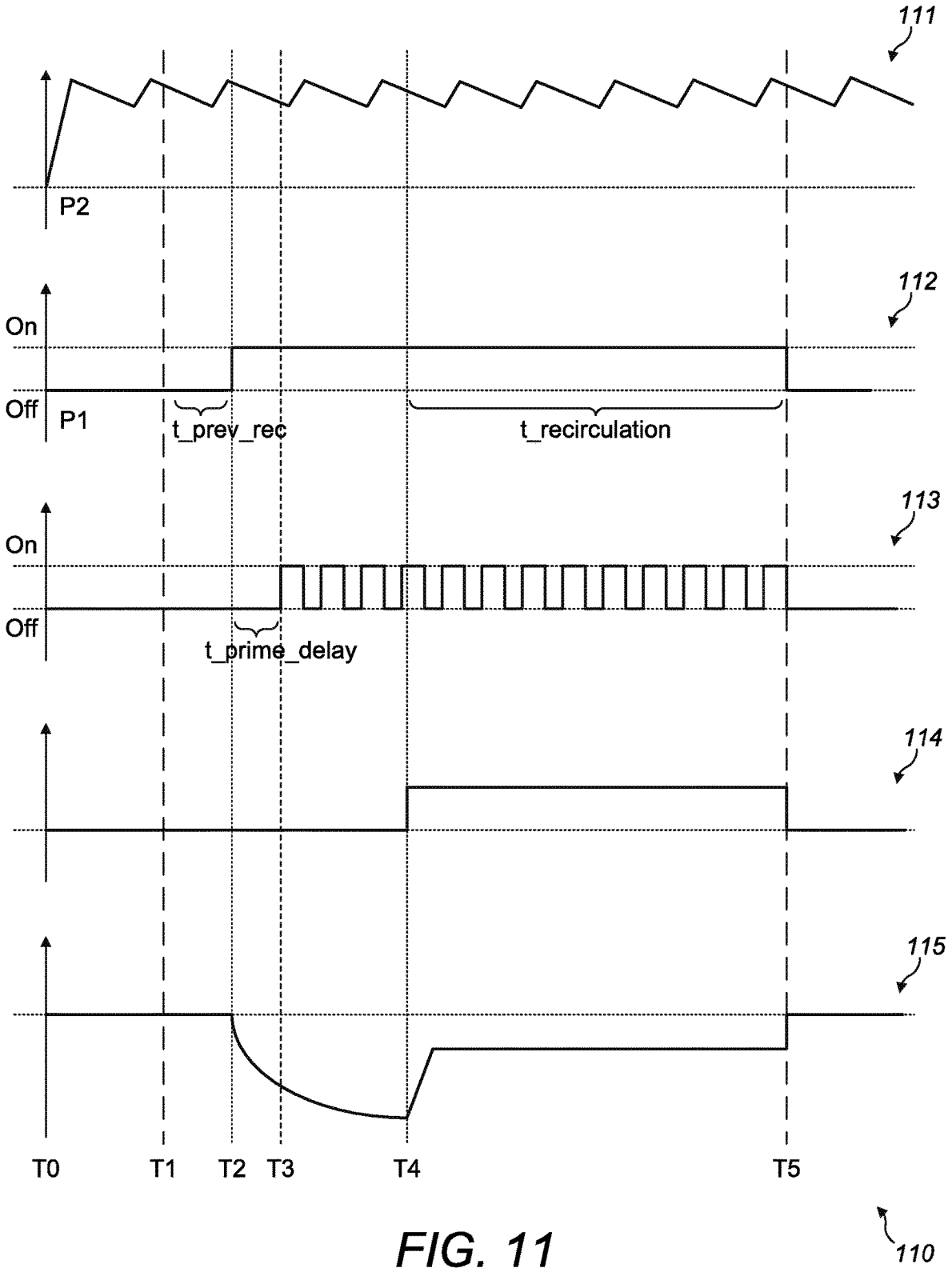
FIG. 11 is a sequence diagram showing an algorithm in accordance with an example.

FIG. 11 is a sequence diagram showing an algorithm, indicated generally by the reference numeral 110, in accordance with an example. The graphs 111, 112, 113, 114, and 115 illustrate the operation of the second fluid pump P2, the first fluid pump P1, the first priming pump (for example P4), the pressure sensor PIP1, and the pressure sensor PIP2 respectively.

Time T0 is a starting time. At time T0, the second fluid pump P2 creates a positive fluid pressure according to graph 111. A recirculation cycle starts at time T0 and ends at time T5.

Algorithm 110 may cause a first time period (for example, the time period between T0 and T1) to pass when a recirculation cycle starts, such that there is at least a time equal to the first time period between each recirculation cycle. For example, before time T0, there may have been a previous recirculation cycle, and the first time period allows the printing device to return to an initial setting. The first time period may, for example, be 5 seconds, although other durations are possible. During the first time period, all valves (for example V1 to V8) and all ports (for example the first and second ports 56*a* and 56*b*) may be closed in order to ensure that the printhead 12 and regulators (such as regulators 57*a* and 57*b*) of the printhead 12 are steady and stable.

At time T2 (after a first time period t_prev_rec after T1), the first fluid pump P1 creates a negative fluid pressure until time T5 according to graph 112. At time T1, one or more valves of the second valve configuration 35 may be opened or closed. The changes in valve positions may cause temporary oscillations on the pressure sensors PIP1 and PIP2. The first time period t_prev_rec may be provided before the first printing fluid pump P1 is activated, such that the temporary oscillations end and the printing device stabilizes before any negative (suction) pressure is applied. This prevents the pressure sensors PIP1 and PIP2 to sense false readings due to the temporary oscillations. In some examples, the period from T1 to T2 may be omitted.

A first pulsed signal is provided at the first priming pump at time T3, for example after a second time period t_prime_delay after time T2, according to graph 113. Algorithm 110 may cause the second time period t_prime_delay to pass after the negative fluid pressure is created at T2, such that the fluid pressure may build up in the flow path of the fluid before the first priming pump is activated. Therefore, the second time period allows some time for creating a negative pressure which may be high enough for starting a flow of printing fluid when the first priming pump is activated. The time t_prime_delay may, for example, be 0.5 seconds, although other durations are possible.

A pressure sensor PIP1 (shown in systems 30, 40, 70, and 90) measures the fluid pressure of fluid near the second printing fluid supply 32. The measurements of the pressure sensor PIP1 is shown in graph 114. The recirculation, i.e. flow of fluid may start at time T4. As shown in graph 114, there may be a delay between the activation of the first fluid pump (at T2) and the start of recirculation or fluid flow (at T4). This is because there may be a delay between activation of the first priming pump (for example priming pump 59*a* of system 100) and the opening of the first port (for example the first port 56*a* in system 100) to open. When the recirculation starts (at T4), the pressure sensor PIP1 measures an increase in fluid pressure; when the recirculation ends (at T5), the pressure sensor PIP1 measures a decrease in fluid pressure.

A pressure sensor PIP2 (shown in systems 30, 40, 70, and 90) measures the fluid pressure of fluid near the first fluid pump P1. The measurements of the pressure sensor PIP2 is shown in graph 115. At time T2, the negative pressure created by the first fluid pump P1 causes the pressure sensor PIP2 to measure a gradual fall (e.g. to a more negative level) in fluid pressure (as shown by a downward curve between time T2 and T4 of the graph 115). At T4, as the recirculation starts, and the printing fluid starts to flow, the pressure measured at the pressure sensor PIP2 starts to increase (e.g. towards zero). The pressure may then rise to a steady value, and remain at the steady value until the end of the recirculation cycle at T5.

A recirculation period (t_recirculation) running from the time T4 to the time T5, during which time ink recirculates in the system, may, for example, be 70 seconds, although other durations are possible.

Figure 12:
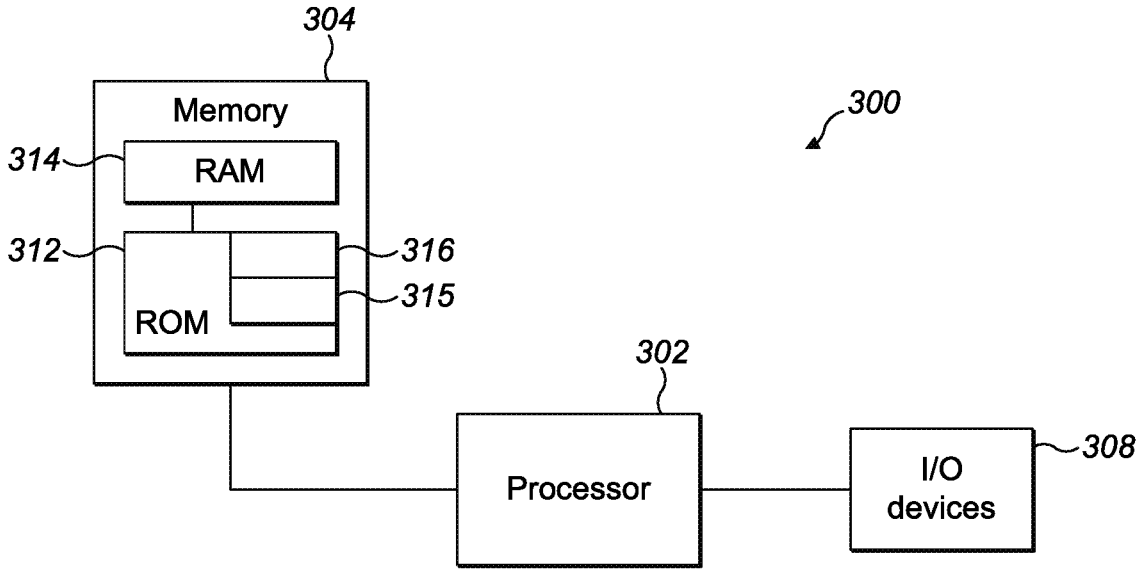
FIG. 12 is a block diagram of an example system.

FIG. 12 is a schematic diagram of components of one or more of the examples described previously, which hereafter are referred to generically as a processing system 300. The processing system 300 may, for example, be used in the control of a printhead described herein.

The processing system 300 may have a processor 302, a memory 304 coupled to the processor and comprised of a RAM 314 and a ROM 312, and may have one or more input and/or output (I/O) devices 308. The processor 302 is connected to each of the other components in order to control operation thereof.

The memory 304 may comprise a non-volatile memory, such as a hard disk drive (HDD) or a solid state drive (SSD). The ROM 312 of the memory 304 stores, amongst other things, an operating system 315 and may store software applications 316. The RAM 314 of the memory 304 is used by the processor 302 for the temporary storage of data. The operating system 315 may contain code which, when executed by the processor implements aspects of the algorithms 50 and 60 described above. Note that in the case of small device/apparatus the memory can be most suitable for small size usage i.e. not always a hard disk drive (HDD) or a solid state drive (SSD) is used.

The processor 302 may take any suitable form. For instance, it may be a microcontroller, a plurality of microcontrollers, a processor, or a plurality of processors.

In some examples, the processing system 300 may also be associated with external software applications. These may be applications stored on a remote server device/apparatus and may run partly or exclusively on the remote server device/apparatus. These applications may be termed cloud-hosted applications. The processing system 300 may be in communication with the remote server device/apparatus in order to utilize the software application stored there.

If desired, the different functions discussed herein may be performed in a different order and/or concurrently with each other. Furthermore, if desired, one or more of the above-described functions may be optional or may be combined.

It is also noted herein that while the above describes various examples, those description should not be viewed in a limiting sense. Rather, there are several variations and modification which may be made without departing from the scope of the present invention, as defined in the appended claims.

The invention claimed is:

1. A printing device comprising:

a printhead comprising a first port connected to a first flow path and a second port connected to a second flow path;

a first fluid pump to selectively create a negative fluid pressure between one of one or more printing fluid supplies and a first one of said first and second ports of said printhead;

a second fluid pump to selectively create a positive fluid pressure between one of said printing fluid supplies and a second one of the first and second ports of the printhead;

first and second regulators having first and second priming pumps and first and second regulator bags associated with the first and second ports of the printhead, wherein the second priming pump is configured to inflate the second regulator bag; and a controller coupled to the second priming pump, wherein the controller is configured to perform a pulsed priming operation by providing pulsed signals to the second priming pump for a recirculation cycle time period to repeatedly inflate the second regulator bag to keep the second port of the printhead open over a threshold open position such that printing fluid within the printhead exits the printhead through the second port.

2. The printing device of claim 1, wherein the printing fluid supplies comprise an intermediate tank and/or ink cartridge.

3. The printing device of claim 1, wherein a first pulsed signal of the pulsed signals has a duration in excess of 60 seconds.

4. The printing device of claim 1, wherein a first pulsed signal of the pulsed signals has a duty cycle of 50%.

5. The printing device of claim 1, further comprising:

first and second levers connected to first and second valves; and wherein the second lever is configured to open the second valve when the second regulator bag is inflated.

6. A printing device comprising:

a first fluid pump to selectively create a negative fluid pressure between one of one or more printing fluid supplies and a first one of first and second ports of a printhead;

a second fluid pump to selectively create a positive fluid pressure between one of said printing fluid supplies and a second one of the first and second ports of the printhead; and first and second regulators having first and second priming pumps and first and second regulator bags associated the first and second ports of the printhead, wherein the second priming pump when activated is configured to provide a pumping action to inflate the second regulator bag; and a controller coupled to the second priming pump, wherein the controller is configured to provide a plurality of pulsed signals to the second priming pump for a recirculation cycle time period to repeatedly inflate the second regulator bag to keep the second port of the printhead open over a threshold open position such that printing fluid within the printhead exits the printhead through the second port.

7. The printing device of claim 6, wherein a first pulsed signal of the plurality of pulsed signals is initiated after the first fluid pump is activated and/or the first fluid pump is activated after the second fluid pump is activated.

8. The printing device of claim 6, wherein a first pulsed signal of the plurality of pulsed signals has a duration in excess of 60 seconds.

9. The printing device of claim 6, wherein a first pulsed signal of the plurality of pulsed signals has a duty cycle of 50%.

10. The printing device of claim 6, further comprising:

first and second levers connected to first and second valves; and wherein the second lever is configured to open the second valve when the second regulator bag is inflated.

11. A method comprising:

selectively generating a negative fluid pressure between one of one or more printing fluid supplies and at least one of first and second ports of a printhead;

selectively generating a positive fluid pressure between one of said printing fluid supplies and a at least one of the first and second ports of the printhead; and providing a plurality of pulsed signals to a regulator having a priming pump and a regulator bag associated with one of the first and second ports, wherein the plurality of pulsed signals activate the priming pump to provide a pumping action to inflate the regulator bag during a recirculation cycle time period to keep one of the first and second ports of the printhead open over a threshold open position such that printing fluid within the printhead exits the printhead through the first or second ports.

12. The method of claim 11, wherein a first pulsed signal of the plurality of pulsed signals has a duration in excess of 60 seconds.

13. The method of claim 11, wherein a first pulsed signal of the plurality of pulsed signals has a duty cycle of 50%.

14. The method of claim 11, wherein when the second regulator bag inflates it causes a lever to open a valve to open one of the first and second ports to release the printing fluid.

* * * * *